United States Patent [19]

Weigele et al.

[11] 4,134,341

[45] Jan. 16, 1979

[54] DUPLICATING APPARATUS

[75] Inventors: Reinhold Weigele, Korntal; Kurt Moser, Gerlingen, both of Germany

[73] Assignee: Rolf Erich Müller, Fed. Rep. of Germany

[21] Appl. No.: 755,809

[22] Filed: Dec. 30, 1976

[30] Foreign Application Priority Data

Dec. 30, 1975 [DE] 12301975 ..... 2559140

[51] Int. Cl.[2] ..... B41F 19/00

[52] U.S. Cl. ..... 101/142; 101/1; 101/426; 101/470; 355/3 R; 355/14

[58] Field of Search ..... 355/3 R, 14; 101/1, 101/426, 470, 468, 141, 143, 144; 197/1 R

[56] References Cited

U.S. PATENT DOCUMENTS

| | | | |
|---|---|---|---|
| 3,536,396 | 10/1976 | Pixler | 355/3 R |
| 3,702,586 | 11/1972 | Kaneko et al. | 101/142 |
| 3,724,940 | 4/1973 | Koizumi | 355/3 R |
| 3,856,125 | 12/1974 | Post | 355/14 |
| 3,861,306 | 1/1975 | DuBois et al. | 101/132.5 |
| 3,936,180 | 2/1976 | Willard | 355/3 R |
| 3,973,846 | 8/1976 | Sullivan et al. | 355/3 R |
| 3,977,780 | 8/1976 | Cassano et al. | 355/3 R |
| 3,987,722 | 10/1976 | Goodwin | 101/141 |
| 3,999,852 | 12/1976 | Katayama et al. | 101/470 |

OTHER PUBLICATIONS

Paper Sheet Tray Arrangement, W. Goff et al., IBM Technical Disclosure Bulletin, vol. 16, No. 4, p. 1264, 9/73.

Laser Copier/Printer, Williams, IBM Technical Disclosure Bulletin, vol. 19, No. 3, p. 806, 8/76.

*Primary Examiner*—William Piephz

*Attorney, Agent, or Firm*—Craig & Antonelli

[57] ABSTRACT

A duplicating arrangement which includes a copying machine for copying an original and an offset printing machine operatively connected to the copying machine for producing prints from a master copy. The copying machine and the offset printing machine are both constructed so as to be independently functional modules with an automatic control device being provided for controlling the operation of the copying machine and offset printing machines such that, depending upon the duplications to be made, the duplicating arrangement feeds a copy from the copying machine to either a depository or the offset printing machine, wherein the copy so-forwarded serves as a master copy in the offset printing machine.

33 Claims, 6 Drawing Figures

FIG.1
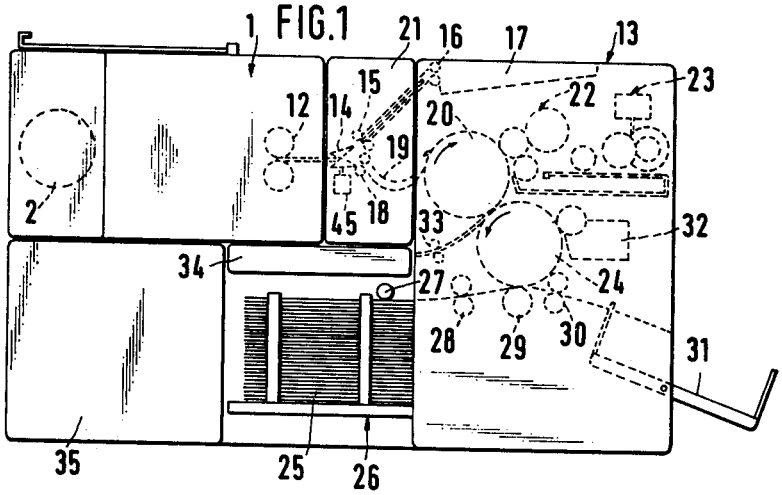
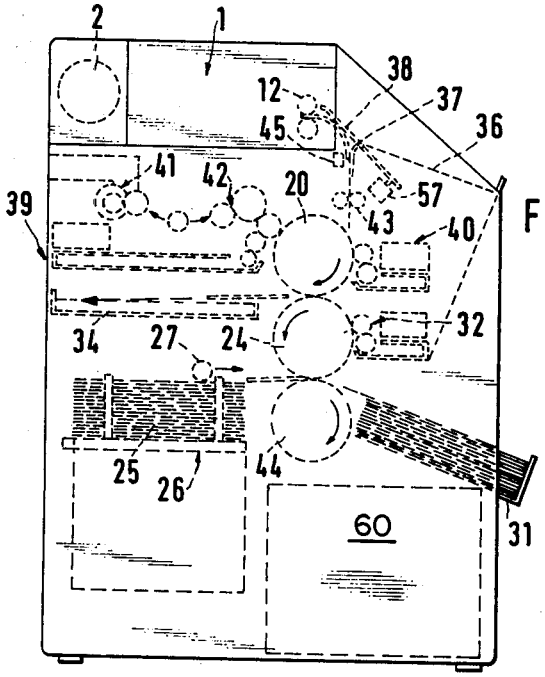
FIG.2

FIG.5
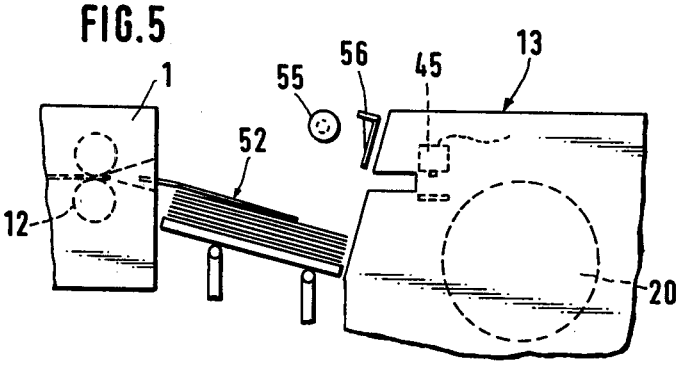
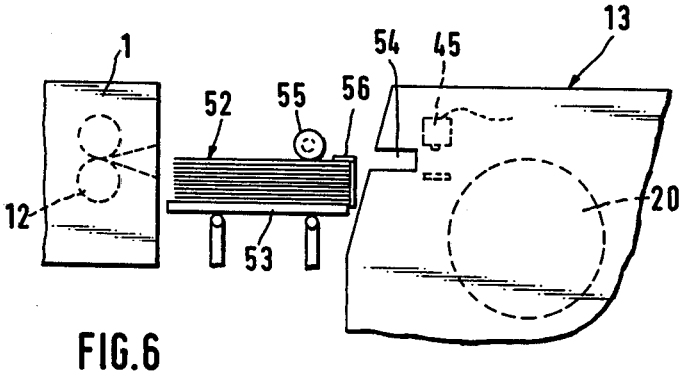
FIG.6

DUPLICATING APPARATUS

The present invention relates to a duplicating arrangement and, more particularly, to a duplicating arrangement which comprises a copying machine and an offset printing machine operatively connected thereto.

In large office operations, a great variety of different duplicating tasks must be accomplished and, in some cases, only one copy has to be prepared of a one-page or multiple-page document, whereas in other cases, a large number of copies must be prepared from a one-page or multiple-page document or the like, especially in situations involving forms or paper blanks. Just as varying as the duplicating tasks are the requirements to be met by the devices used for duplication of originals.

Conventional copying machines are preferably employed for the production of a small or minor number of copies of an original; however, it is also possible, with the aid of modern copying machines, to obtain a relatively large number of copies within a relatively short period of time. A disadvantage of these modern copying machines resides in the high construction costs which are manifested as a relatively high price for the copying machine and also as a relatively high cost per individual copy.

In order to prepare a large number of duplicates, small offsetting printing machines, so-called office printers, are utilized which operate economically and inexpensively in situations wherein a plurality of duplications are desired. These so-called "Multilith" copiers are particularly economical if the required master copies or printing plates can be produced in a simple manner.

It has been proposed to manufacture master copies for the office printers of a zinc oxide copying material in an economical manner; however, in the heretofore proposed devices, the duplicating methods are not essentially favorable in their operation under practical conditions since additional manual labor must be carried out after producing the master copy which is disadvantageous in that the operating personnel and master copy become soiled. Therefore, in practice, it is necessary for the proposed devices to employ an especially skilled person for the operation of the device which, in turn, leads to a rise in the cost per copy.

In Auslegeschrift No. 1,761,513, a copying arrangement is proposed wherein a copying machine together with an offset printing machine is combined to form a single copying apparatus. In this construction, the master copies are fed mechanically to an offset printing machine which then produces the copies. Moreover, a direct print is prepared from the copies produced in a mirror-image fashion by means of a planography method in order to thereby simplify the offset printing machine. A disadvantage of this proposed construction and similar devices resides in the fact that they are too expensive to utilize when producing only individual copies or a small number of copies since, in such cases, the entire copying apparatus must always be placed in operation. Furthermore, a master copy, which in actuality may be unnecessary, is additionally prepared.

The aim underlying the present invention essentially resides in providing a copying arrangement which includes a copying machine and an offset printing machine which is capable of producing individual copies as well as multiple copies in an economical operation. For this purpose, the copying machine is constructed as an independently functioning unit which selectively passes on the copies produced thereby to at least one of a depository or the like or the offset printing machine.

Several advantages are attained by the present invention in that it is possible to prepare and issue single copies or a small number of copies by way of the independently operable copier itself, without having to place the entire copying apparatus in operation, and it is also possible to produce multiple copies without having to utilize another copying device. Moreover, the entire copying operation may be effected without any manual work on the part of the operating personnel.

In accordance with one advantageous feature of the present invention, an automatic control arrangement is provided which regulates, in dependence upon a preferred setting, stored number of duplications, the preparation of copies or of prints. By virtue of this feature, it is no longer necessary for the user, who in many cases is uninformed, to decide and determine the most economical setting, but rather such step is executed by the copying arrangement itself in accordance with predetermined criteria stored therein.

According to yet another feature of the present invention, the control mechanism contains, for this purpose, an adjustable or settable counter adjustable for counting the duplications, which counter automatically controls, above a predetermined number of duplications, the preparation of a copy which is fed to an offset printing machine as a master copy.

By a still further feature of the present invention, provision is made that the offset printing machine is an independently operable module having an outlet which is accessible from the outside to permit the introduction of master copies. By virtue of this construction, it is possible to process master copies of a different material by means of the offset printing machine other than master copies produced by the copying machine, i.e., master copies which have been produced by a device other than the copier, for example, of a different material.

By virtue of yet another feature of the present invention, the operating program of the copying arrangement, controlling the production of a copy and the transmittal of such copy to the offset printing machine, includes a delay member controlling a preferably adjustable transporting of the copying material with respect to the device for the transfer of an image. By this construction, it is possible to attach an additional gripping edge at the master copy required for clamping the master copy into a plate cylinder of the offset printing machine without thereby losing image information in such zone.

Accordingly, it is an object of the present invention to provide a copying arrangement which avoids by simple means the shortcomings and drawbacks encountered in the prior art.

Another object of the present invention resides in providing a copying arrangement which automatically regulates the copying of an original so as to economically optimize the production of the copies.

A still further object of the present invention resides in providing a copying arrangement which obviates the need for any specially trained operating personnel.

These and other objects, features and advantages of the present invention will become more apparent from the following description when taken in connection with the accompanying drawing which shows, for the purposes of illustration only, several embodiments of a copying arrangement in accordance with the present invention, and wherein:

FIG. 1 is a schematic side view of a table model of a copying arrangement in accordance with the present invention;

FIG. 2 is a schematic side view of a floor or console model of a copying arrangement in accordance with the present invention;

FIG. 5 is an enlarged detail view of a further embodiment of the present invention in a first operating position; and FIG. 6 is a detail view of the embodiment of FIG. 5 in another operating position.

Figure 3:
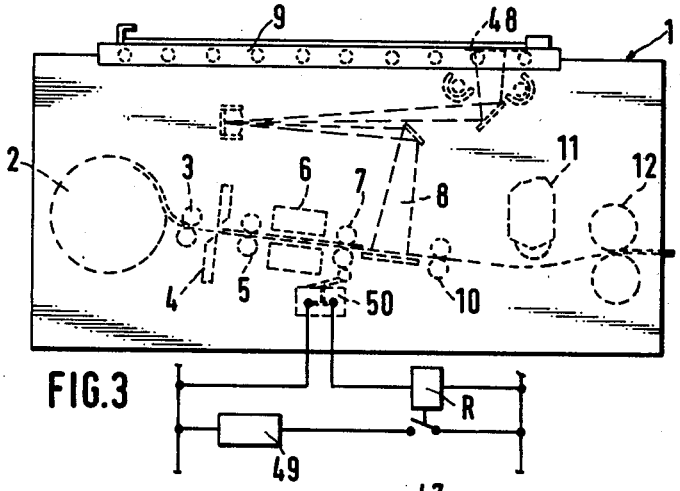
FIG. 3 is an enlarged detail view of a component of the copying arrangements of FIGS. 1 or 2.

Referring now to the drawings wherein like reference numerals are used throughout the various views to designate like parts and, more particularly, to FIGS. 1 and 3, according to these figures, a copying machine generally designated by the reference numeral 1, fashioned as an independently functioning module, is provided which includes a storage reel 2 upon which is arranged a copying material such as a zinc oxide coated carrier material, for example, coated paper. The copying material is conducted by way of transporting rollers 3 through a cutting station 4 for effecting a cutting of the copying material to a desired format.

A pair of transporting rollers 5 are arranged downstream of the cutting station 4 preceding a corona device 6 with transporting rollers 7 being arranged after the corona device 6 for transporting the copying material to an image transfer unit 8 disposed downstream of the transporting rollers 7. The image transfer unit 8 transfer an image onto the copying material from a conveyor slide 9 which receives the original to be copied and which moves in synchronism with the copying material.

The copying material, to which has been applied a latent charge image by way of the corona device 6 and the image transfer unit 8 in correspondence with the image information contained on the original, is fed by way of a pair of transporting rolls 10 to a developing station which may be constructed, for example, as a powder mill 11 which delivers a one- or two-component powder to the copying material in a distribution corresponding to the charge pattern on the copying material. The powder mill may be, for example, the type described in commonly assigned United States patent application Ser. No. 498,235, now U.S. Pat. No. 4,002,145, and Ser. No. 645,343, the disclosures of which are incorporated herein by reference to the extent necessary in understanding the present invention, or the type disclosed in U.S. Pat. No. 3,176,652.

A fixing station is arranged upstream of the developing station which, in the illustrated embodiment, includes a pair of pressure rolls 12 which fix the image on the copy material and issue the finished copy. The fixing station may be of the type described in commonly assigned U.S. patent application Ser. No. 498,236, now U.S. Pat. No. 4,022,122, the disclosure of which is incorporated herein by reference to the extent necessary in understanding the present invention. In the present field of application, the use of a pair of pressure rolls 12 or other fixation devices operating with dry media is advantageous since the copying material is not altered as occurs, for example, in a developer bath partially by swelling. Of course, it is also possible in accordance with the present invention to utilize copying machines having a different construction and executing the copying work, for example, on precut sheets or utilizing a wet developing station.

The copy finished in the copy unit 1 in accordance with the present invention may, on the one hand, represent a finished product and, on the other hand, represent an intermediate product wherein the copy from the copying machine 1 is fed to an offset printing machine generally designated by the reference numeral 13 disposed downstream of the copying machine 1, whereby the copy from the copying machine 1 forms the master copy for the offset printing machine 13.

The path travelled by the copy produced by the copying machine 1 is controlled by a reversible switch 14 which, in one position, connects a conveyor path with two additional pairs of transporting rolls 15, 16 to the outlet of the copier 1, leading to a receptacle or depository 17 arranged at the top side of the housing of the offset printing machine 13. The switch 14, in a second position, connects the outlet of the copier 1 to a pair of transporting rolls 18 associated with an etching unit 19. The unit 19 includes an outlet followed by a plate cylinder 20 of the offset printing machine 13.

As can be seen most clearly from FIG. 1, the switch 14 which may be actuated or switched, for example, by way of an electromagnet, in a manner not illustrated in detail, is arranged in a housing component 21 disposed between the copier 1 and the offset printing machine 13. The housing component 21 accommodates the etching unit 19 and associated transporting rollers 18 so that a favorable space utilization of the entire copying apparatus is readily obtained.

The offset printing machine 13 is constructed in a customary manner of the so-called office printing machine and includes a plate cylinder 20 associated with devices generally designated by the reference numerals 22, 23 of driven and adjustable rolls by means of which liquid and ink are applied to the plate cylinder 20 and/or to a master copy (not shown) clamped in position at that location. A rubber blanket cylinder 24 is arranged upstream of and operatively associated with the plate cylinder 20 with the cylinder 24 having the image to be produced applied thereon in mirror-image fashion by the master copy clamped to the plate cylinder 20. The rubber blanket cylinder 24 transfers the image to a sheet fed to the cylinder 24 from a stack 25 of a paper-feeding mechanism generally designated by the reference numeral 26.

The paper-feeding mechanism 26 includes an elevator table with the paper stack disposed thereon. A take-off roller 27 is associated with the paper stack 25 for introducing the paper to be imprinted by way of a pair of transporting rolls 28 disposed upstream of the rubber blanket cylinder 24 and impression cylinder 29. After the image has been transferred from the cylinder 24 to the paper, the printed paper is taken off the rubber blanket cylinder 24 in a known manner, not shown in detail, and fed by way of a further pair of transporting rolls 30 to a receptacle or depository 31 which accommodates the prints produced by the offset printing machine. A washing means 32 is associated with the rubber blanket cylinder 24 for removing the ink or the like from the cylinder 24 upon completion of a printing operation.

After the offset printing operation, the master copies are removed from the plate cylinder and fed by way of a pair of transporting rolls 33 to a used master copy receptacle or depository 34. The used master receptacle or depository 34 and the paper-feeding mechanism 26 may be arranged in the copying apparatus so that they can be pulled out of a side wall of the entire apparatus in the manner of a drawer in order to remove the used master copies and to replenish the paper in the paper-feeding mechanism 26.

A housing 35 is arranged between the paper-feeding mechanism 26 and a free end face of the copying machine 1, whereby the entire copying apparatus takes the form of a compact cubic shape. The housing 35 may accommodate, in a manner not illustrated in detail, the electrical circuits and air supply devices such as fans or the like. By virtue of the construction illustrated in FIG. 1, all of the parts of the copying apparatus, which are preferably combined into individual modules, are individually freely accessible for the purposes of servicing of the respective elements.

The copying apparatus of FIG. 2 corresponds, in principle, to the apparatus of FIG. 1 with respect to the mode of operation and includes a copier 1, the details of which are shown most clearly in FIG. 3, which copier has an outlet end controlled by a flap 38 to selectively direct the copy from the copying machine to a receptacle or depository 36 or to an inlet 37 leading to an offset printing machine generally designated by the reference numeral 39 arranged essentially below the copying machine 1. Selective control of the flap 38 is effected by way of an electromagnet 57 and a spring (not shown). Upon actuation of the electromagnet 57, the flap 38 is displaced to a first position against the bias of the spring and, upon de-energization of the magnet, the spring biases the flap 38 into a second position.

The offset printing machine 39 of FIG. 2 differs from the offset printing machine 13 of FIG. 1 essentially in that the etching unit generally designated by the reference numeral 40 is directly associated with the plate cylinder 20, whereby the master copy need not be conducted through a liquid bath prior to being clamped to the plate cylinder 20, whereby the etching takes place with the aid of the etching unit 40 on the plate cylinder 20.

As in the apparatus of FIG. 1, devices generally designated by the reference numerals 41, 42 are associated with the plate cylinder 20 for feeding ink and liquid thereto. Each of the devices 41, 42 include rolls which are driven and adjusted in a conventional manner.

The copy which serves as the master copy for the offset printing machine 39, that is, the copy produced by the copying machine 1 or another copier or the like, enters the offset printing machine 39 by way of the inlet 37 and is conveyed to the plate cylinder 20 by way of a pair of transporting rolls 43. The front edge of the master copy is clamped onto the plate cylinder 20 by a conventional clamping means (not shown). The plate cylinder 20 then rotates several times during which period first the etching and then the moistening and application of the ink are effected prior to placing the cylinder 20 in association with the rubber blanket cylinder 24 disposed therebelow.

The rubber blanket cylinder 24, associated with a washing unit 32, transfers the image obtained from the master copy on the plate cylinder 20 by way of an impression cylinder 44 to a sheet withdrawn from a stack 25 of the paper-feeding mechanism 26. A sheet from the feeding mechanism 26 is directed between the rubber blanket cylinder 24 and impression cylinder 44 by a take-off roller 27 with the processed sheet then being directed to a receptacle or depository 31.

Feeding mechanism 26, provided with an elevator table, is arranged beside the rubber blanket cylinder 24 and impression cylinder 44 with a storage compartment 34 being arranged above the feeding mechanism 26, which storage compartment serves for accommodating used master copies. A space 60 may be provided beneath the impression cylinder 44 adjacent the paper-feeding mechanism 26 for accommodating switching elements or the like of the copying apparatus.

In the copying arrangements of FIGS. 1 and 2, the copying machine 1 as well as the offset printing machines 13 or 39 are independently operable units, each of which is controlled in accordance with its own operating program so that all of the functions of the respective copying elements proceed independently of one another in a desired fashion. While the copying machine 1 is turned on by way of a start switch, the offset printing machine is turned on by way of a switching element 45 arranged at the inlet 37 of the offset printing machine 13 or 39, which switching element detects the entrace of a copy serving as the master copy and provides a starting signal for the offset printing machine 13 or 39. The switching element 45 may be constructed as a mechanical, electrical, or optical sensor or the like responding to the front edge of the entering master copy.

Figure 4:
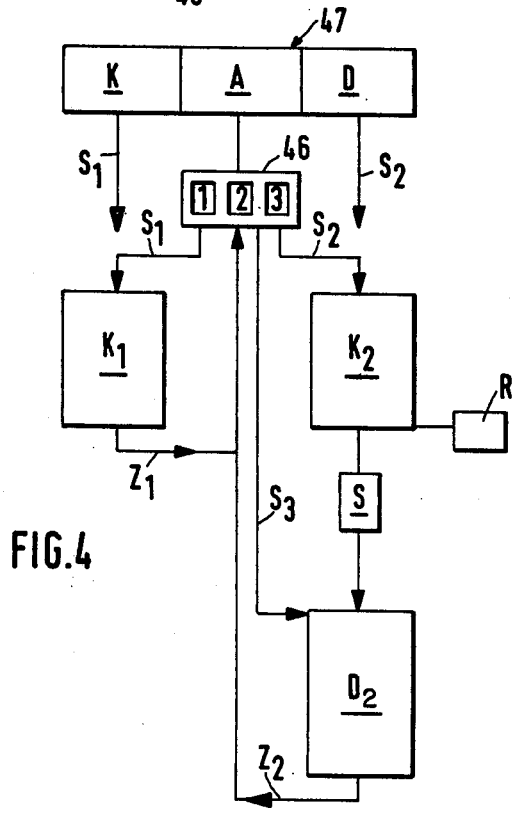
FIG. 4 is a schematic block diagram of a control arrangement for the copying arrangement of FIGS. 1 or 2 in accordance with the present invention.

FIG. 4 provides a schematic illustration of the control arrangement for controlling the operation and switching of the copying apparatus of FIGS. 1 or 2. Specifically, a counter 46 and a selector switch generally designated by the reference numeral 47 are mounted at an arbitrary location of the copying apparatus. The desired number of copies is set by the operating personnel in the counter 46 and, thereafter, the selector switch 47 is actuated to start the apparatus. The copying apparatus of FIG. 1 or FIG. 2 is designed so that it automatically makes a decision in the normal case as to the type of duplicating which is most economical for the desired number of copies, that is, providing only copies from the copying machine 1 and/or the offset printing machine 13 or 39.

Under practical conditions, with a small number of duplications, for example, where less than ten copies are desired, it would not be worthwhile to turn on the entire apparatus so that, in such case, only the copying machine 1 is rendered operational. In case of a larger number of copies, it is more economical to produce the same in the form of prints by the offset printing machine 13 or 39. In such a situation, the counter 46, after actuation of a starting key A of the selector switch 47, transmits, in dependence upon the set number of copies, different signals $S_1$ and $S_2$ triggering correspondingly different operations of the copying apparatus.

The signals $S_1$ and $S_2$ are fed to two different operating program arrangements $K_1$ and $K_2$ which control the functionings of the entire copying apparatus and simultaneously take care of either depositing the copies either in the receptacles or depositories 17 and 36, respectively, or transmitting the copies to the offset printing machine 13 or 39. The operating program arrangement $K_1$ is the customary operating program of a copying machine 1 by means of which the one-time or repeated copying of an original is controlled. The copies are counted at an arbitrary place of the copier and this information is transmitted to the counter 46 by way of a signal $Z_1$. Once the preselected number of copies has been reached, the counter 46 transmits the signal for terminating the copying operation. For this purpose, it is possible, for example, to have the signal $S_1$ remain as a permanent signal which disappears when a predetermined number of copies has been attained.

The signal $S_2$ of counter 46, which is transmitted starting with a certain predetermined number of duplications, is fed to a second operating program arrangement $K_2$ corresponding substantially to the operating program $K_1$ and controlling the operating steps in the copying machine 1. In this connection, a suitable switching means (not shown) can be used to cause the signal $S_2$ to be present only for the period of time required by the copying machine 1 for the production of one copy and to disappear at that time so that the copying machine 1 is shut off.

The operating program arrangement $K_2$ controls an adjusting means S for the switch 14 or flap 34 by means of which the copy, either produced by the copying machine 1 or otherwise introduced, which now serves as the master copy, is introduced into the offset printing machine 13 or 39. The copy serving as the master copy triggers an operating program arrangement D of the offset printing machine 13 or 39.

The offset printing machine includes a counter (not shown) which transmits a signal $Z_2$ back to the counter 46 so that the counter 46 records the number of prints produced by the offset printing machine 13 or 39. The counter 46 transmits a signal $S_3$ to the operating program arrangement $D_2$ of the offset printing machine 13 or 39 after the set number of copies has been produced, thereby triggering a signal for turning off the offset printing machine 13 or 39 and depositing the used master copy in the storage compartment 34.

The selector switch 47 may be fashioned so that it becomes possible, even independently of the number of copies set at the counter 46, to direct the copying apparatus of FIGS. 1 or 2 to produce either copies or prints, that is, to effect a copying procedure even in cases of a high number of reproductions or to execute a printing operation even in case of a low number of copies. For this purpose, additional keys K and D, constructed as signal-generating means, can be provided by means of which the signals $S_1$ and $S_2$ are introduced into the corresponding operating program arrangements $K_1$ and $K_2$ independently in order to circumvent or by-pass the counter 46. In this connection, suitable conventional interlock means (not shown) must be provided in order that only one of the keys A, D or K can be depressed while the others remain blocked during such operation.

When utilizing the offset printing machine 13 or 39 for master copies which have not been produced in the copying machine 1 and which may consist, for example, of a different copying material, one need only provide the possibility of introducing such master copies into the offset printing machine 13 or 39 and, in this case, the program of the printing machine is triggered by way of the switching element 45 completely independently of the copying machine 1. In this construction, the counter 46 may be utilized to turn off the offset printing machine 13 or 39 after the predetermined number of prints has been produced. The construction for introducing the master copies can be arranged in a simple manner in the zone of the switch 14 or the flap 38.

In the case of a copying machine, it is customary to respectively transfer an image section of the original to the copying material in each copying operation. For this purpose, the original or an exposure device and the copying material are made to move in synchronism. In the copying machine 1, the details of which are shown most clearly in FIG. 3, provision is made that the original is placed on a slide 9 moving synchronously with the copying material with respect to the image transfer until 8 transferring an exposed area of the original by way of an optical system to an electrostatically charged copying material.

In the construction of FIG. 3, the original is placed on the slide 9, equipped with a glass plate, in such a manner that the original abuts with its front edge against a stop strip 48. During this step, the original is still located outside of the region of the image transfer unit 8. The slide 9 is suitably connected to the same drive mechanism which effects the advancement of the copying material transported with the aid of transporting rollers 3, 5, 7 and 10 from the storage reel 2 through the copying machine 1. The slide 9 is provided with a clutch arrangement 49, indicated as a circuit symbol, and is coupled to the drive mechanism by way of the clutch 49 as soon as the copying material has reached the zone of the image transfer unit 8. The coupling is accomplished by way of a sensor switch 50 arranged in the zone of the pair of transporting rolls 7, which sensor switch responds to the front edge of the passing copying material.

During a normal copying operation, the drive of the slide 9 is coupled to the system so that the slide moves in synchronism with the copying material and provision is made that the original is transferred to the copying material with maximum congruence so that subsequently all of the information contained on the original is also present on the copy.

If the copy produced by the copying machine 1 is utilized as the master copy and fed to the offset printing machine 13 or 39, the front edge of the so-produced copy is introduced into a clamping means (not shown) of the plate cylinder 20. To avoid the possibility that the clamped edge carries image information, provision is made in accordance with the present invention that the copying material has a certain lead with respect to the slide 9 so that an additional clamping edge is obtained which has no image information thereon.

For this purpose, with the operating program $K_2$ in use, the clutch 49 is not connected directly by way of switch 50, but rather by way of an adjustable timing relay R. The timing relay is set so that, due to the lead of the copying material and/or due to a delayed entrainment of the slide 9, a clamping edge of a sufficient length is obtained which carries no image information. Under practical operating conditions, it is advantageous if the clamping edge is exposed so that it remains white, whereby the print to be produced does not carry a black bar or the like caused by the presence of such clamping edge. To accomplish this, a stop strip 48 is provided with white paint on its underside, that is, the side facing the image transfer unit 8.

As shown most clearly in FIG. 4, the timing relay R is associated only with the operating program arrangement $K_2$ rather than the operating program arrangement $K_1$. The operating program arrangements $K_1$ and $K_2$, illustrated in FIG. 4 as separate elements, differ merely in that, in the case of the operating program $K_2$, the timing relay R is switched and the output signal, that is, the signal $Z_2$ counting the copies, is transmitted to a setting member S rather than to the counter 46. By virtue of this construction, it is possible in practice to effect the operative control of the copying apparatus with only a single operating program which is differently switched in correspondence with a desired operating condition.

During the reproduction of a multi-page original at a number justifying the use of the offset printing machine 13 or 39, it is advantageous first to produce all master copies which are then placed into a type of buffer station or storage means, whereby, automatically, the last-produced master copy is fed as the first master copy to the offset printing machine 13 or 39 so that the last page of the original is duplicated first. This is advantageous since, after the entire procedure has been finished, the resulting stack of printed copies is arranged in the correct sequence of pages.

As shown in FIGS. 5 and 6, the buffer station or storage means may be fashioned as a depository generally designated by the reference numeral 52 which is arranged between the copying machine and the offset printing machine 13. All of the copies produced by the copying machine 1 are transported to the depository 52 and, by virtue of its accessibility, such copies can easily be withdrawn therefrom.

As shown most clearly in FIG. 6, the depository 52 includes an elevator table 53 which can lift the depository 52 so that the uppermost copy is located in opposition to an inlet 54 of the offset printing machine. If desired, a vibrating mechanism (not shown) can be operatively connected to the elevator table 53 so as to effect a vibrating motion of the elevator table 53, whereby the copies disposed thereon assume an exact positioning. Upon the elevator table reaching the position illustrated in FIG. 6, feed rollers 55 engage the upper surface of the top copy and separators 56 encompass the corners of the stack of copies. The feed rollers 55 and separators 56 function to individually feed the copies to the offset printing machine 13 which is placed in operation by way of the switching element 45 which is placed in operation by virtue of the operating program arrangement $D_2$. The adjustment of the elevator table 53, the feed rollers 55 and separators 56 is controlled by a start control means triggered by the operating program arrangement $K_2$ of the copying apparatus, which operating program arrangement is responsible for the preparation of prints by the offset printing machine 13.

By virtue of the construction of FIGS. 5 and 6, it is possible in a simple manner to introduce master copies to the offset printing machine which have been produced by another master copy producing device and which may, for example, consist of a different copying material since the depository 52 and inlet 54 are readily accessible.

Moreover, it is possible to arrange a feed slot (not shown) leading, for example, to the pair of transporting rolls 3 at the copying machine 1 through which slot special master copies may be fed by hand, for example, if an especially high number of prints is to be produced from a certain master copy.

As noted above, any desired copying machine can actually be utilized; however, the drawing of copying material from a storage reel 2 has the advantage that any desired formats can be copied and that a clamping edge for clamping at the plate cylinder 20 can be produced without any great difficulties. It is also possible to utilize devices which withdraw the copying material in the form of precut sheets from a stack or from a cassette. In certain cases, it may be necessary, or at least expedient, to provide stacks or cassettes having differing sheet formats in order to provide a clamping action for the plate cylinder of the printing machine 13 or 39. In this latter situation, the machine serving for the printing operation must be controlled so that, prior to the start of the copying by the printing machine, the correct stack or correct cassette is switched or placed in its correct operative position. By the use of a similar principle, it is also possible to employ a copier which copies on normal paper, with such copier being equipped with a second stack, second cassette or a second storage reel from which the material is withdrawn, which is utilized for the production of master copies.

If the copying arrangement of the present invention is to be utilized for the reproduction of confidential or secret information, it is advantageous to combine the receptacle or depository 34 of the offset printing machine 13 or 39 with a paper shredder (not shown) which destroys the used master copy. It is also possible to provide, at the outlet of the offset printing machine 13 or 39, a collating arrangement or sorting device (not shown) by means of which the prints are composed into finished sets.

Also, it is possible in accordance with the present invention to provide the copying machine with a suitable extension (not shown), thereby making it possible to introduce images from microfilms into the copying machine and to copy and/or print such images by the copying machine and/or the offset printing machine 13 or 39.

While we have shown and described several embodiments in accordance with the present invention, it is understood that the same is not limited thereto, but is susceptible of numerous changes and modifications as known to a person skilled in the art, and we therefor do not wish to be limited to the details shown and described herein, but intend to cover all such changes and modifications as are encompassed by the scope of the appended claims.

We claim:

1. A duplicating arrangement which includes a copying means for making either at least one copy or a single master copy of an original by the same copying process, and an offset printing means operatively connected to said copying means for producing prints from said master copy, characterized in that said copying means is constructed as an independently functional module, and in that means are provided for selectively feeding the at least one copy from said copying means to a depository means when the selected number of copies is below a predetermined threshold number and said single master copy from said copying means to the offset printing means when the selected number of copies is equal to or above said threshold number.

2. An arrangement according to claim 1, characterized in that said offset printing means includes an inlet means for receiving the master copy, and in that switch means are provided for actuating a printing operation program means of said offset printing means for controlling the printing operation thereof.

3. An arrangement according to claim 1, characterized in that said offset printing means is an offset printing machine constructed as a structural group of elements functionally independent of said copying means, and in that an inlet means is provided at said offset printing machine which permits an introduction of a master copy produced other than by said copying means.

4. An arrangement according to claim 1, characterized in that said means for selectively feeding the copy from said copying means includes a selectively operable switch means interposed between said copying means and said offset printing means.

5. An arrangement according to claim 4, characterized in that said selectively operable switch means is arranged in an independent module element interposed between said copying means and said offset printing means.

6. An arrangement according to claim 5, characterized in that said offset printing means includes a plate cylinder means for receiving the master copy, and in that an etching means is disposed in said independent module upstream of said plate cylinder means.

7. An arrangement according to claim 1, characterized in that the depository means is interposed between the copying means and the offset printing means.

8. A duplicating arrangement which includes a copying means for making a copy of an original, and an offset printing means operatively connected to said copying means for producing prints from a master copy with the copy from said copying means serving as the master copy, characterized in that said copying means is constructed as an independently functional module, and in that means are provided for selectively feeding the copy from said copying means to one of a depository means and the offset printing means, in that control means are provided for automatically controlling the production of copies from the copying means and prints from said offset printing means in dependence upon a predetermined number of duplications to be made, in that said control means includes a counter means for counting a number of duplications to be made, means for operatively connected with said counter means for regulating said copying means and said offset printing means including at least two different operating program means associated with said counter means, said copying means and said offset printing means, a first of said operating program means regulates said copying means so as to produce at least one copy and feed the same to said depository means, a second of said operating program means regulates said copying means to produce only one copy and feed the same to said offset printing means as the master copy, in that said counter means is constructed as a signal transmitter for providing a signal to one of said operating program means in dependence upon a selected number of duplications set on said counter, and further characterized in that means are provided for by-passing said counter means so as to cause said copying means to be regulated in accordance with the first operating program means regardless of the counted number of duplications on said counter means.

9. An arrangement according to claim 8, characterized in that said by-pass means is a signal-generating means operatively connected with the counter means and the first operating program means.

10. An arrangement according to claim 8, characterized in that a second by-pass means is provided for by-passing said counter means so as to cause said copying means to be regulated in accordance with the second operating program means regardless of the selected number of duplications on the counter means.

11. An arrangement according to claim 10, characterized in that said second by-pass means is a signal-generating means operatively connected to said counter means and said second operating program means.

12. An arrangement according to claim 10, characterized in that said offset printing means is an offset printing machine constructed as a structural group of elements functionally independent of said copying means, and in that said inlet means of said offset printing machine is accessible so as to permit an introduction of master copies produced other than by said copying means.

13. An arrangement according to claim 12, characterized in that said means for selectively feeding the copy from said copying means includes a selectively operable switch means interposed between said copying means and said offset printing machine.

14. An arrangement according to claim 13, characterized in that said selectively operable switch means is arranged in an independent module element interposed between said copying means and said offset printing machine.

15. An arrangement according to claim 14, characterized in that said offset printing machine includes a plate cylinder means for receiving the master copy, and in that an etching means is disposed in said independent module upstream of said plate cylinder means.

16. An arrangement according to claim 12, characterized in that the depository means is interposed between the copying means and the offset printing machine.

17. An arrangement according to claim 16, characterized in that means are arranged at said depository means for supplying individual copies from said depository means into said offset printing machine.

18. An arrangement according to claim 17, characterized in that said depository means is constructed as a buffer station for accumulating all copies intended as master copies for the offset printing machine.

19. An arrangement according to claim 18, characterized in that start control means are arranged at said buffer station for starting a supplying of individual master copies from said buffer station to the offset printing machine, said start control means being operatively connected to said second operating program means so as to be triggered thereby.

20. An arrangement according to claim 19, characterized in that the copy from said copying means is made on a copying material supplied to the copying means, and in that means are provided for delaying the initiation of at least one of said operating program means for a predetermined time subsequent to a receipt of a signal from said counter means so as to provide a predetermined lead on the copying material supplied to the copying means.

21. An arrangement according to claim 20, characterized in that the delaying means are adjustable so as to control the length of the lead of the copying material.

22. An arrangement according to claim 21, characterized in that said copying means includes a slide means for receiving an original to be copied, and in that an abutment means is arranged at said slide means for engaging a front edge of the original, means are provided for selectively displacing said slide means with respect to an image transfer means of the copying means, and in that said delaying means is operatively connected with said displacing means of said slide means so that said slide means is displaced only after a predetermined lead is provided on the copying material.

23. An arrangement according to claim 22, characterized in that said abutment means is provided on a side thereof facing the image transfer means with a material such that the predetermined lead of the copying material is exposed to the image transfer means of the copying means.

24. An arrangement according to claim 8 characterized in that means are provided for by-passing said counter means so as to cause said copying means to be regulated in accordance with the first operating program means regardless of the counted number of duplications on said counter means.

25. An arrangement according to claim 24, characterized in that said by-pass means is a signal-generating means operatively connected with the counter means and the first operating program means.

26. An arrangement according to claim 25, characterized in that a second by-pass means is provided for by-passing said counter means so as to cause said copying means to be regulated in accordance with the second operating program means regardless of the counted number of duplications on the counter means.

27. An arrangement according to claim 26, characterized in that said second by-pass means is a signal-generating means operatively connected to said counter means and said second operating program means.

28. A duplicating arrangement which includes a copying means for making a copy of an original, and an offset printing means operatively connected to said copying means for producing prints from a master copy with the copy from said copying means serving as the master copy, characterized in that said copying means is constructed as an independently functional module, and in that means are provided for selectively feeding the copy from said copying means to one of a depository means and the offset printing means, in that the depository means is interposed between the copying means and the offset printing means, and in that said depository means includes a table means for receiving copies from said copying means and means for selectively displacing said table means from a copy-receiving position to a copy-feeding position for feeding the copies into the offset printing means.

29. An arrangement according to claim 28, characterized in that means are provided at said depository means for aligning and individually feeding the copies therefrom into said offset printing means when said table means is in said second position.

30. An arrangement according to claim 29, characterized in that means are provided for vibrating said table means prior to displacement from said first position to said second position so as to exactly orient the copies at the table means for subsequent feeding into the offset printing means.

31. A duplicating arrangement which includes a copying means for making a copy of an original, and an offset printing means operatively connected to said copying means for producing prints from a master copy with the copy from said copying means serving as the master copy, characterized in that said copying means is constructed as an independently functional module, and in that means are provided for selectively feeding the copy from said copying means to one of a depository means and the offset printing means, characterized in that at least two different operating program means are associated with said copying means and said offset printing means, a first of said operating program means regulates said copying means so as to produce at least one copy and feed the same to said depository means, a second of said operating program means regulates said copying means to produce only one copy and feed the same to said offset printing means as a master copy, means are operatively connected with the second of said operating program means for providing a lead of a predetermined length on a copy from the copying means which is to be fed to the offset printing means.

32. An arrangement according to claim 31, characterized in that said copying means includes a slide means for receiving an original to be copied, an abutment means is arranged at said slide means for engaging a front edge of the original, means are provided for selectively displacing said slide means with respect to an image transfer means of the copying means, and in that said means for providing a lead of a predetermined length on a copy to be fed to the offset printing means is operatively connected with said displacing means of said slide means so that said slide means is displaced only after the lead of the predetermined length is provided on the copy.

33. An arrangement according to claim 23, characterized in that said abutment means is provided on a side thereof facing the image transfer means with a material such that the lead of the predetermined length provided on the copy is exposed to the image transfer means of the copying means.

* * * * *